US009655426B2

(12) United States Patent
Bremner

(10) Patent No.: US 9,655,426 B2
(45) Date of Patent: May 23, 2017

(54) HAIR COLOR APPLICATOR

(71) Applicant: DCB Products, Byron Center, MI (US)

(72) Inventor: Dana Bremner, Caledonia, MI (US)

(73) Assignee: DCB Products, Byron Center, MI (US)

( * ) Notice: Subject to any disclaimer, the term of this patent is extended or adjusted under 35 U.S.C. 154(b) by 159 days.

(21) Appl. No.: 14/796,170

(22) Filed: Jul. 10, 2015

(65) Prior Publication Data

US 2016/0007711 A1 Jan. 14, 2016

Related U.S. Application Data

(60) Provisional application No. 62/023,153, filed on Jul. 10, 2014.

(51) Int. Cl.

| | |
|---|---|
| ***A45D 19/02*** | (2006.01) |
| ***A45D 19/00*** | (2006.01) |
| ***A46B 5/04*** | (2006.01) |
| ***A45D 7/04*** | (2006.01) |
| *A45D 7/00* | (2006.01) |

(52) U.S. Cl.

CPC ..... *A45D 19/0008* (2013.01); *A45D 7/04* (2013.01); *A45D 19/02* (2013.01); *A46B 5/04* (2013.01); *A45D 2007/001* (2013.01); *A45D 2019/0066* (2013.01); *A45D 2019/0091* (2013.01)

(58) Field of Classification Search

CPC ..... A45D 19/008; A45D 19/02; A45D 2019/025; A45D 2019/0066; A45D 2019/0091; A45D 24/36; A45D 7/04; A45D 2007/001; A46B 5/04

USPC ..... 15/214; 132/149

See application file for complete search history.

(56) References Cited

U.S. PATENT DOCUMENTS

| | | | | |
|---|---|---|---|---|
| 3,030,968 | A * | 4/1962 | Oberstar | A45D 19/0008 132/212 |
| 4,942,893 | A | 7/1990 | Trottier | |
| 6,062,231 | A | 5/2000 | De Laforcade | |
| 6,079,420 | A | 6/2000 | Musum | |
| 7,866,326 | B2 * | 1/2011 | Mills | A45D 19/0008 132/112 |
| 8,132,574 | B2 * | 3/2012 | Baker | A45D 19/0008 132/208 |
| 8,186,363 | B2 * | 5/2012 | Smith | A45D 19/0008 132/208 |
| 8,353,304 | B2 | 1/2013 | Smith et al. | |
| 8,479,748 | B1 * | 7/2013 | Satir | A45D 24/10 132/108 |
| 8,505,554 | B2 * | 8/2013 | Smith | A45D 19/0008 132/208 |
| 2006/0248785 | A1 | 11/2006 | Shelton | |

(Continued)

FOREIGN PATENT DOCUMENTS

| | | |
|---|---|---|
| FR | 2848787 | 6/2004 |

*Primary Examiner* — Tatiana Nobrega

(74) *Attorney, Agent, or Firm* — The Watson I.P. Group, PLC; Jovan N. Jovanovic; Vladan M. Vasiljevic

(57) ABSTRACT

A hair color applicator includes a first gripper arm, a second gripper arm and a hinge. The first gripper arm has an applicator panel. The second gripper arm has an applicator panel. The hinge couples the first gripper arm to the second gripper arm so as to have the applicator panels movable relative to each other toward and into a generally abutting position. Each of the gripper arms may have a reservoir disposed on the respective applicator panel which is configured to retain a hair colorant.

20 Claims, 4 Drawing Sheets

(56) References Cited

U.S. PATENT DOCUMENTS

| | | | | |
|---|---|---|---|---|
| 2008/0083418 | A1* | 4/2008 | Glenn | A45D 19/0016 132/208 |
| 2008/0083420 | A1* | 4/2008 | Glenn | A45D 19/0008 132/208 |
| 2008/0087293 | A1* | 4/2008 | Glenn | A45D 19/0008 132/210 |
| 2008/0087294 | A1* | 4/2008 | Glenn | A45D 19/0008 132/221 |
| 2010/0101595 | A1* | 4/2010 | Glenn, Jr. | A45D 19/0008 132/208 |
| 2010/0139684 | A1* | 6/2010 | Smith | A45D 19/0008 132/208 |
| 2012/0272995 | A1* | 11/2012 | Da Silva | A46B 9/023 132/270 |
| 2014/0048095 | A1* | 2/2014 | Curry | A45D 19/0008 132/270 |
| 2014/0332026 | A1* | 11/2014 | Peters | A45D 19/0008 132/221 |

* cited by examiner

HAIR COLOR APPLICATOR

CROSS-REFERENCE TO RELATED APPLICATION

The present application claims priority from U.S. Provisional Patent Application Ser. No. 62/023,153 filed Jul. 10, 2014, entitled "Hair Color Applicator", the entire disclosure of which is hereby incorporated by reference in its entirety.

BACKGROUND OF THE DISCLOSURE

1. Field of the Disclosure

The invention relates in general to the field of cosmetology, and more particularly, to a hair color applicator configured to facilitate the application of color to hair.

2. Background Art

In the hair stylist and cosmetologist industry in addition to trimming and cutting hair, it is often desirable to change the color of the hair of the customer. In certain instances, a complete hair color change is effectuated in a single uniform color. In other instances, it is desirable to change the hair color in only portions of the hair, or with only certain strands, or with only certain portions of certain strands.

Problematically, such partial coloring (and to some extent full coloring) is a laborious and tedious process, wherein colorant is applied selectively to hair. So as to achieve the desired look, the colorist must individually apply color (with, for example, a brush or the like) to the desired areas.

It would be advantageous if such an application of colorant could be achieved with greater time savings.

In addition, it would be advantageous if such an application of colorant could be achieved at a lower cost.

Further still, it would be advantageous if the foregoing advantages could be realized without compromising the quality of the services offered by the colorist.

These and other advantages are achieved through the utilization of the hair color applicator of the present disclosure.

SUMMARY OF THE DISCLOSURE

The disclosure is directed to a hair color applicator that includes a first gripper arm, a second gripper arm and a hinge. The first gripper arm has an applicator panel. The second gripper arm has an applicator panel. The hinge couples the first gripper arm to the second gripper arm so as to have the applicator panels movable relative to each other toward and into a generally abutting position.

Each of the gripper arms may have a reservoir disposed on the respective applicator panel which is configured to retain a hair colorant.

Additionally, each of the reservoirs may include a plurality of flexible ribs to provide enhanced colorant to hair interaction.

The disclosure is also directed to a method of using the hair color applicator on a customer or an individual. In particular, the user (i.e., colorist) grasps the first and second gripper arms. Preferably, the thumb extends into the inner cavity of the first gripper arm and the index and middle finger (or other fingers) extend into the second gripper arm. The user then applies colorant onto the applicator surfaces of one or both of the applicator arms. The user then grasps hair that is to be colored and inserts the hair into the space between the gripper arms, and rotates the two arms relative to each other so that the hair is sandwiched therebetween. Such a configuration transfers the colorant onto the hair.

With greater particularity, in an aspect of the disclosure, the disclosure is directed to a hair color applicator comprising a first gripper arm, a second gripper arm and a hinge coupling the first gripper arm to the second gripper arm. The first gripper arm has a first applicator panel. The first gripper arm also includes a proximal end, a distal end, a first side edge and a second side edge. The second gripper arm has a second applicator panel. The second gripper arm has a proximal end, a distal end, a first side edge and a second side edge. The hinge coupling couples the first gripper arm to the second gripper arm proximate the proximal end. In such a configuration, the applicator panels are movable relative to each other toward and into generally abutting position.

In some configurations, at least one of the first applicator panel and the second applicator panel comprises an applicator surface comprising a centrally located reservoir with a frame extending therearound. The centrally located reservoir includes a concave surface having a plurality of protrusions extending inwardly therefrom.

In some configurations, the plurality of protrusions extend inwardly from the concave surface comprising a plurality of ribs extending along the concave surface.

In some configurations, the plurality of ribs extend between the first side edge and the second side edge, generally parallel to the hinge.

In some configurations, the plurality of ribs comprise a plurality of rib pairs positioned in a spaced apart orientation. The rib pairs have a rib pair spacing. The rib pair spacing is smaller than the spacing between adjacent rib pairs.

In some configurations, each of the plurality of ribs has a substantially rectangular cross-sectional configuration.

In some configurations, the centrally located reservoir further includes a first end wall and a second end wall. The concave surface is substantially uniform between the first end wall and the second end wall so as to define a substantially uniform cross-sectional configuration.

In some configurations, the plurality of protrusions comprise a plurality of ribs extending in a substantially parallel configuration between the first end wall and the second end wall and substantially perpendicular thereto.

In some configurations, the plurality of ribs comprise a plurality of rib pairs positioned in a spaced apart orientation. The rib pairs have a rib pair spacing. The rib pair spacing is smaller than the spacing between adjacent rib pairs.

In some configurations, the frame that extends around the centrally located reservoir further includes a frame channel defined therein. The frame channel extends from the first end wall to the first side edge of the applicator panel, to, in turn, provide a channel for hair exiting therefrom.

In some configurations, each of the first applicator panel and the second applicator panel further includes an applicator surface comprising a centrally located reservoir, with a frame extending therearound. The centrally located reservoir includes a concave surface having a plurality of protrusions extending inwardly therefrom.

In some configurations, the centrally located reservoirs and the frame extending therearound are substantial mirror images of each other about the hinge.

In some configurations, the protrusions of the first applicator panel and the protrusions of the second applicator panel are substantial mirror images of each other.

In some configurations, the plurality of protrusions of each of the first applicator panel and the second applicator panel comprise a plurality of ribs extending in a substantially parallel configuration between the first end wall and the second end wall and substantially perpendicular thereto.

In some configurations, the plurality of ribs comprise a plurality of rib pairs positioned in a spaced apart orientation. The rib pairs having a rib pair spacing, with the rib pair spacing being smaller than a spacing between adjacent rib pairs.

In some configurations, the frame that extends around the centrally located reservoir of each of the first gripper arm and the second gripper arm further includes a frame channel defined therein. The frame channel extends from the first end wall to the first side edge of the applicator panel, to, in turn, provide a channel for hair exiting therefrom.

In some configurations, the frame channel of the first gripper arm is aligned with the frame channel of the second gripper arm.

In some configurations, the frame channel of the first gripper arm and the frame channel of the second gripper arm cooperate to form a substantially cylindrical configuration.

In some configurations, each of the first gripper arm and the second gripper arm include an encircling portion behind the respective applicator panel. Each encircling portion defines an inner cavity with a lower edge opening corresponding to the hinge to provide ingress into the inner cavity, to in turn, allow for the fingers of the user to be positioned therein and to apply force against a back surface of the respective applicator panel, to rotate the first gripper arm relative to the second gripper arm into and out of abutment of the respective applicator panels.

In another aspect of the disclosure, the disclosure is directed to a method of applying color to hair. The method comprises the steps of: providing a hair color applicator, the hair color applicator; placing a hair colorant on at least one of the first applicator panel and the second applicator panel; directing a portion of a length of hair between the first gripper arm and the second gripper arm; rotating the first and second gripper arms about the hinge to sandwich hair between the first gripper arm and the second gripper arm, to, in turn, direct hair colorant onto the hair sandwiched thereby; and slidably directing the hair color applicator along at least a remaining portion of a length of hair to continuously expose the hair colorant to the hair sandwiched thereby.

BRIEF DESCRIPTION OF THE DRAWINGS

The disclosure will now be described with reference to the drawings wherein.

DETAILED DESCRIPTION OF THE DISCLOSURE

Figure 1:
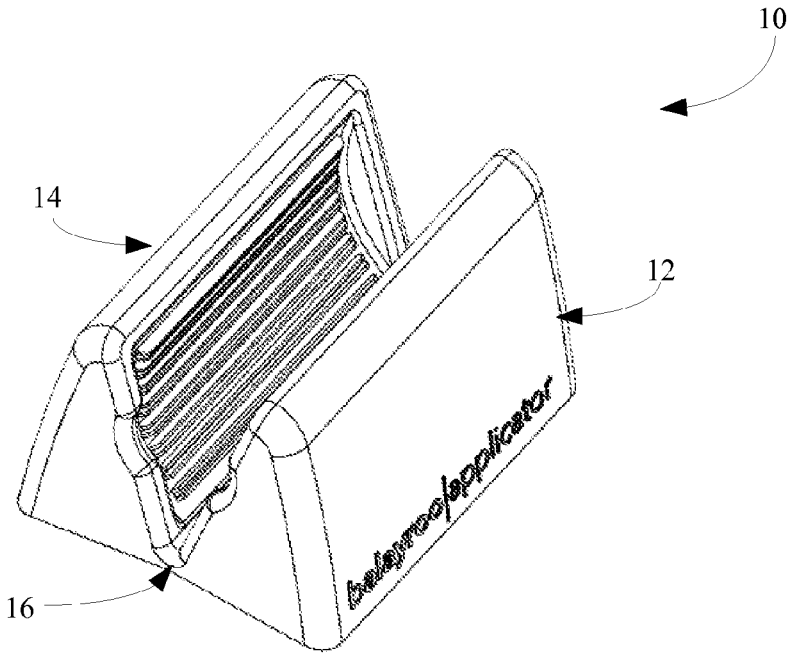
FIG. 1 of the drawings is a right side perspective view of the hair color applicator of the present disclosure.
Figure 2:
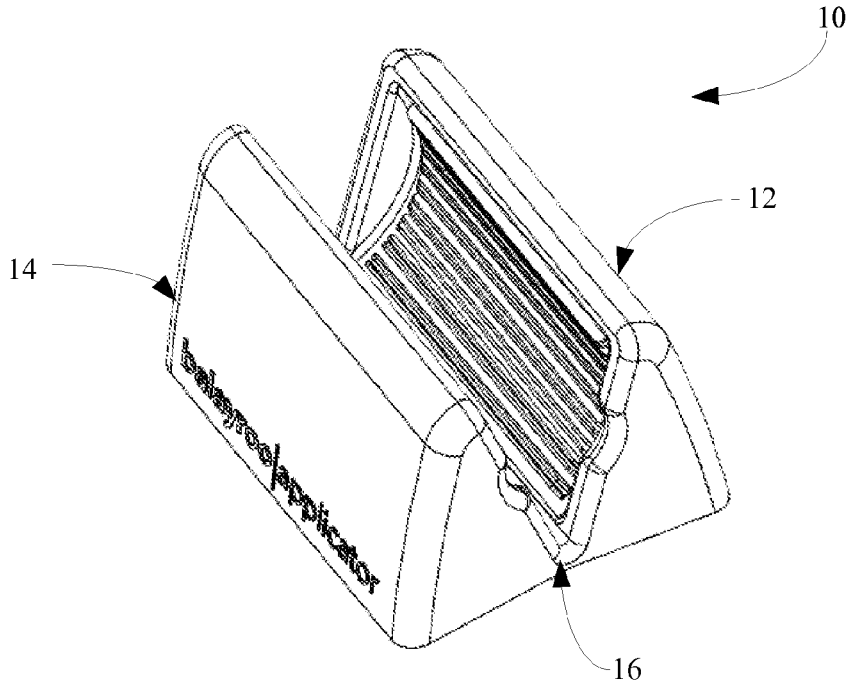
FIG. 2 of the drawings is a left side perspective view of the hair color applicator of the present disclosure.
Figure 3:
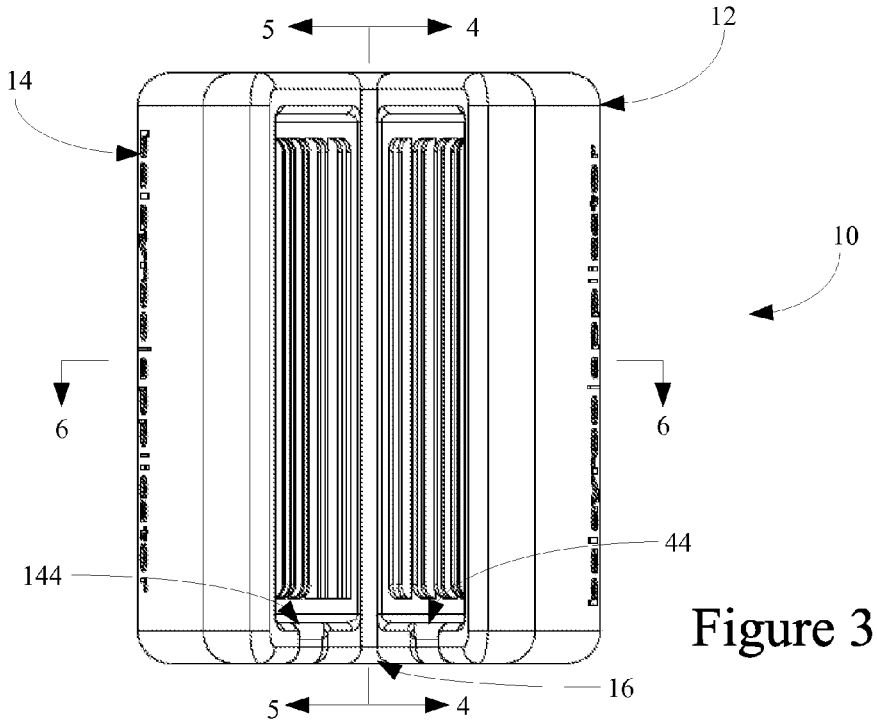
FIG. 3 of the drawings is top plan view of the hair color applicator of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the hair color applicator is shown generally at 10. It will be understood that a single such applicator may be utilized by a hair stylist to color portions of or the entirety of the hair of a customer. It will be understood that in certain embodiments, it may be necessary to employ a number of the applicators, when preparing and coloring hair in a number of different colors (i.e., highlighting). The applicator is generally formed from a flexible polymer, such as a silicone based polymer, such that pressure by the user's fingers can alter the shape of the first and second gripper arms, the concave surfaces and the relative position of the first gripper arm and the second gripper arm (i.e., rotation or pivoting about the hinge 16). Of course, other materials are contemplated as well.

The hair color applicator 10 includes first gripper arm 12, second gripper arm 14 and hinge 16. As will be explained below, the first and second gripper arms 12, 14 are hingedly coupled together about hinge 16 so as to pivot from a position where the two gripper arms are in substantial abutment, to a position wherein they are separated by an angle of between 10° and 60°, for example, while other angles of separation are contemplated such as 90°, 180° or other. In the embodiment wherein the separation is closer to 180°, the system can lie flat on a table preserving colorant within the reservoirs and precluding spillage. In the embodiment shown, the angle between the gripper arms is 36°.

Figure 4:
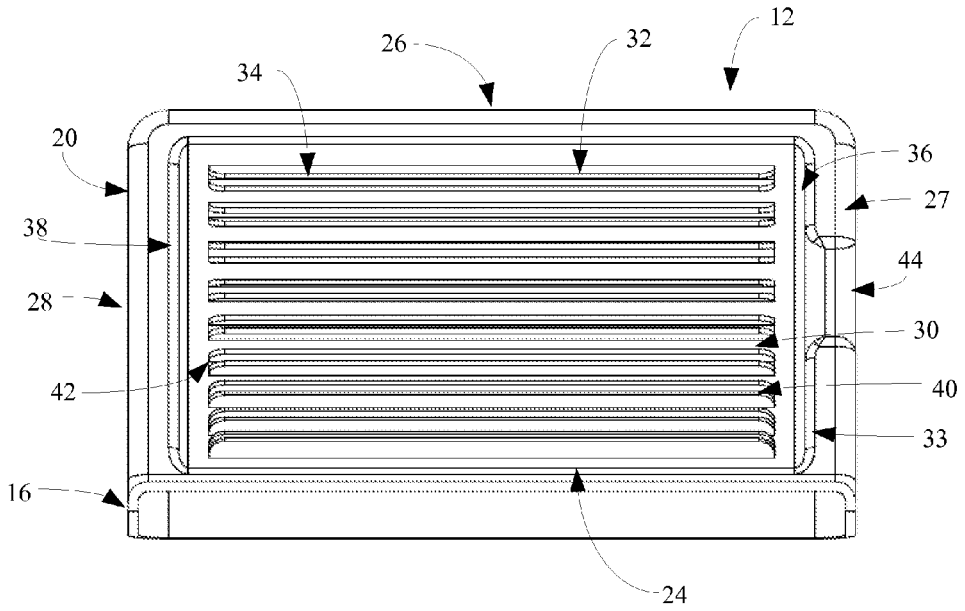
FIG. 4 of the drawings is a cross-sectional view of the hair color applicator of the present disclosure, showing, in particular, the first gripper arm, which is taken generally about lines 4-4 of FIG. 3.
Figure 5:
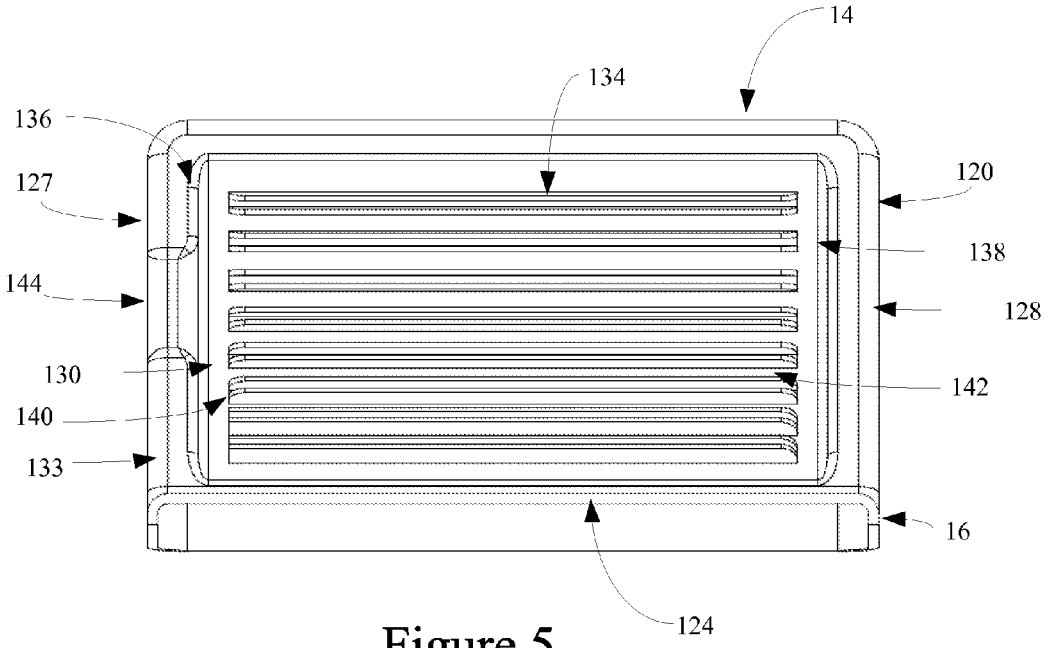
FIG. 5 of the drawings is a cross-sectional view of the hair color applicator of the present disclosure, showing, in particular, the second gripper arm, which is taken generally about lines 5-5 of FIG. 3.

With reference to FIGS. 4, 5 and 65, collectively, in the embodiment shown, the first gripper arm 12 includes applicator panel 20 and encircling portion 22. The applicator panel 20 includes proximal end 24, distal end 26, first side edge 27, second side edge 28 and applicator surface 30. The applicator surface includes a centrally located reservoir 32 which defines a frame 33 therearound. The reservoir 32 includes concave surface 34 with first end wall 36 and second end wall 38. The concave surface 34 comprises a generally uniform portion of a cylinder having its greatest depth at or near the center thereof, and, as such, has a substantially uniform cross-sectional configuration along the length thereof. The first end wall and the second end wall generally comprise a surface having a linear top edge and an arcuate lower edge. Of course other configurations are likewise contemplated wherein the reservoir includes a plurality of sidewalls and a base surface such that the reservoir is concave, with each of the surfaces being substantially planar. In other embodiments, the concave surface may actually be defined as a convex surface, or may have surface undulations. In general the applicator surface includes a reservoir that can retain a desired quantity of colorant therein for application onto the hair of a customer.

The concave surface 34 includes a plurality of flexible ribs 40 which run along the length thereof between the first side edge 27 and the second side edge 28. The flexible ribs 40 are generally parallel to each other and spaced apart from each other so as to define a plurality of channels 42 therebetween. The flexible ribs 40 are also generally parallel to the hinge 16. The flexible ribs provide surface area and contours for the intimate contact between hair and the colorant that is positioned within the reservoir.

Figure 6:
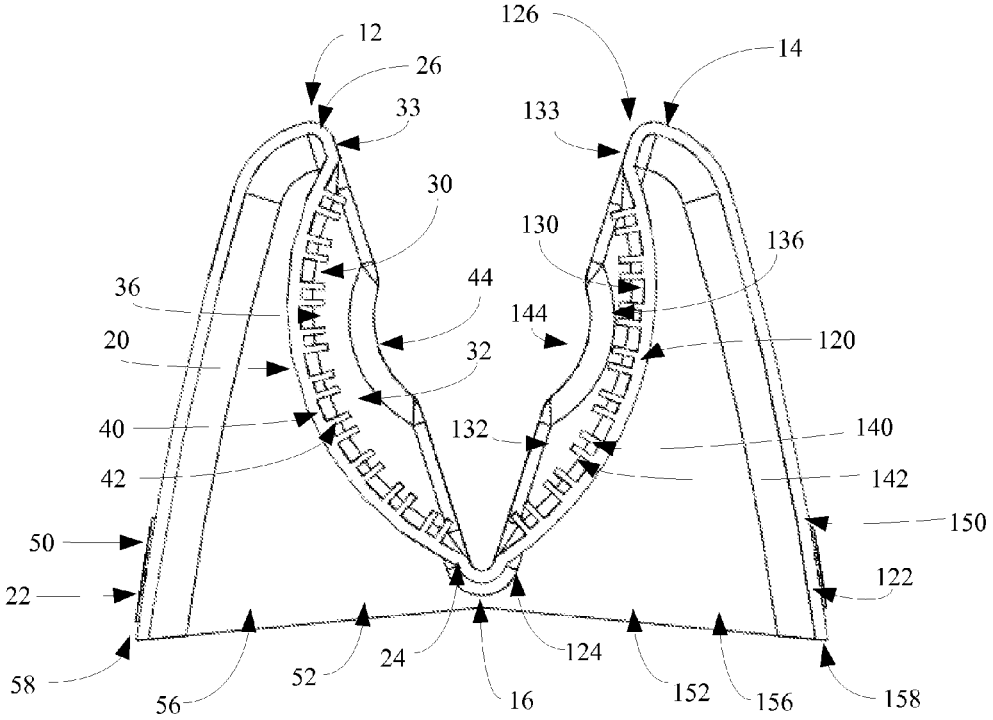
FIG. 6 of the drawings is a cross-sectional view of the hair color applicator of the present disclosure, showing, in particular, the configuration of the applicator panels of the first and second gripper arms, and the encircling portion thereof, taken generally about lines 6-6 of FIG. 3.

The ribs are shown in greater detail in FIG. 6 as comprising a plurality of spaced apart substantially parallel rib members having a generally rectangular cross-sectional configuration. The rib members generally extend perpendicular to the underlying concave surface, and, as such, are slightly angled toward each other due to the concavity of the concave surface.

The ribs comprise rib pairs that are closely spaced together, each rib pair has a rib pair spacing defined as a distance between the ribs forming the rib pair and the ribs pairs are spaced apart from one another by a separation distance. The rib pair spacing being smaller than the separation distance between adjacent rib pairs. Of course, other configurations are contemplated, however, it has been found that such a configuration provides the performance needed. In addition, in the configuration shown, a total of nine pairs of ribs is disclosed.

It will be understood that in other configurations, in the place of ribs, a number of different structures may be utilized, such as bumps, surface undulations, barbs, and other protrusions. In the configuration shown, the ribs extend generally parallel to the direction of the travel of the hair thereagainst.

The frame 33 includes a frame channel 44 positioned proximate the first side edge. The frame channel provides a point of collection for the hair as the hair is pulled through the hair color applicator. In the embodiment shown, the channel comprises a arcuate depression that is generally uniform in cross-sectional configuration across the portion of the frame so that the channel is generally parallel to the flexible ribs and generally parallel to the hinge 16.

Figure 8:
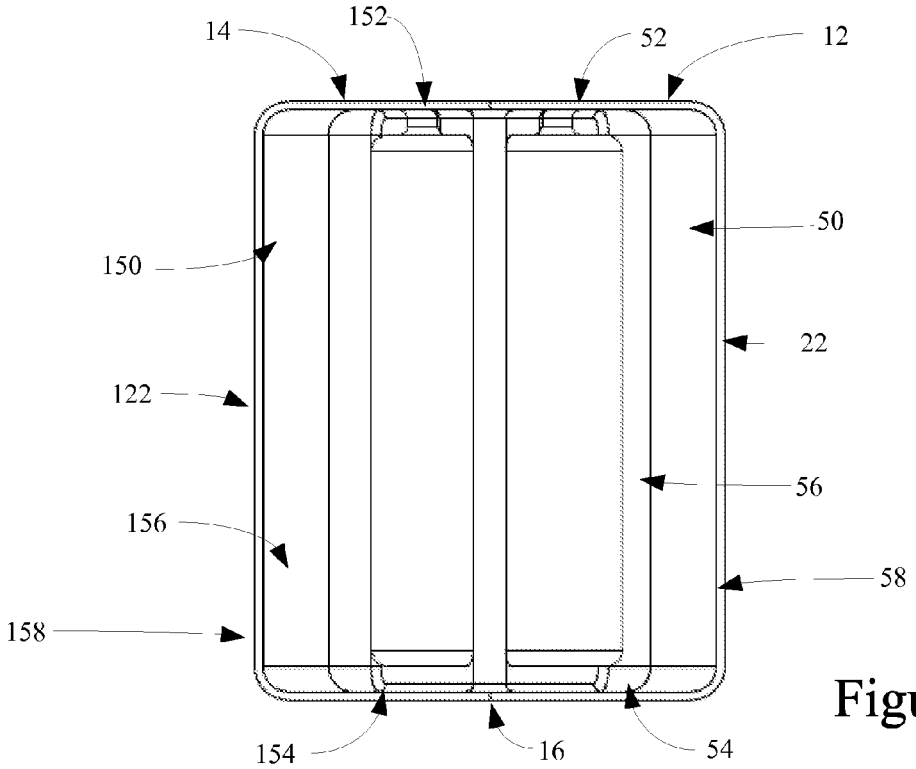
FIG. 8 of the drawings is a bottom plan view of the hair color applicator, showing, in particular, the encircling portion, and the inner cavity of each of the first and second gripper arms, as well as the hinge.
Figure 7:
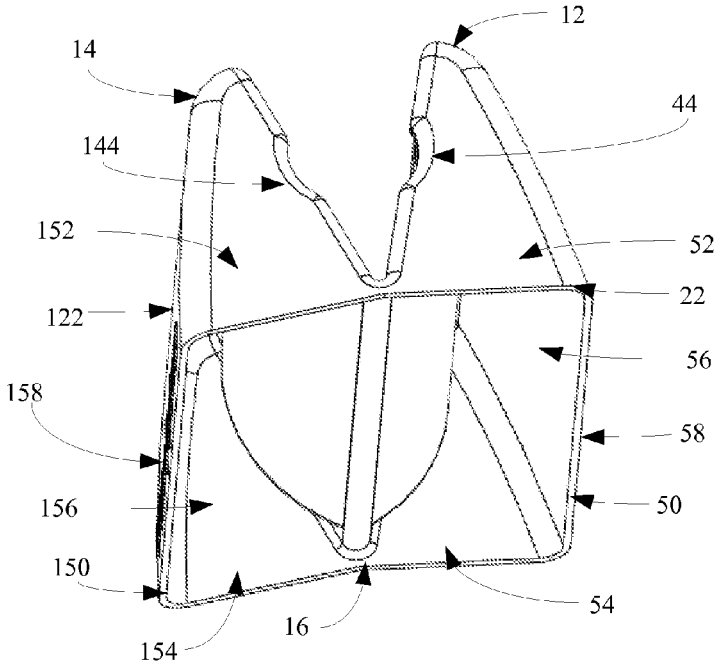
FIG. 7 of the drawings is a bottom perspective view of the hair color applicator, showing, in particular, the encircling portions of each gripper arm, as well as the inner cavity thereof.

With reference to FIGS. 6 through 8, encircling portion 22 extends about the applicator surface so as to define an inner cavity 56 (configured to capture the fingers of a user) with access to the cavity being through lower edge opening 58. In the embodiment shown, the encircling portion includes a back panel 50 as well as first side panel 52 and second side panel 54. The two side panels are triangular in shape so that the inner cavity tapers toward the distal end of the applicator panel, and that it is generally largest at the lower edge opening 58 (although variations are contemplated). It is contemplated that other shapes for the inner cavity are contemplated and it is contemplated that the lower edge opening 58 may be narrower than the largest cross-sectional configuration thereof.

The second gripper arm 14 is substantially a mirror image of the first gripper arm 12, structurally. It will be understood that variations between the first and second gripper arms may be present. For example, the applicator surfaces may be different in that the reservoir may be only on one of the two gripper arms. In addition, the reservoirs may be of different shapes and sizes. Further, the frames may be different and may incorporate different structures, including, but not limited to the frame channel.

With reference to FIGS. 1, 2, 5 and 6, collectively, in the embodiment disclosed, however, the two structures are substantial mirror images of each other. In particular, therefore, second gripper arm 14 includes applicator panel 120 and encircling portion 122. The applicator panel 120 includes proximal end 124, distal end 126, first side edge 127, second side edge 128 and applicator surface 130. The applicator surface includes a centrally located reservoir 132 which defines a frame 133 therearound. The reservoir 132 includes concave surface 134 with first end wall 136 and second end wall 138. The concave surface 134 comprises a generally uniform portion of a cylinder having its greatest depth at or near the center thereof. The first end wall and the second end wall generally comprise a surface having a linear top edge and an arcuate lower edge. Of course other configurations are likewise contemplated wherein the reservoir includes a plurality of sidewalls and a base surface such that the reservoir is concave, with each of the surfaces being substantially planar. In other embodiments, the concave surface may actually be defined as a convex surface, or may have surface undulations. In general the applicator surface includes a reservoir that can retain a desired quantity of colorant therein for application onto the hair of a customer. As identified above, it will be understood that the second gripper arm may not include any type of reservoir, or may comprise a structure that is complementary to the first gripper arm, such that a portion thereof extends into the reservoir of the first gripper arm. Moreover, only one of the two gripper arms may include a reservoir. While mirror image configurations are shown, there are a number of variations that are contemplated wherein the two gripper arms are substantially different.

The concave surface 134 includes a plurality of flexible ribs 140 which run along the length thereof between the first side edge 127 and the second side edge 128. The flexible ribs 140 are generally parallel to each other and spaced apart from each other so as to define a plurality of channels 142 therebetween. The flexible ribs 140 are also generally parallel to the hinge 16. The flexible ribs provide surface area and contours for the intimate contact between hair and the colorant that is positioned within the reservoir. The configuration of the flexible ribs 140 may be the same or different than the flexible ribs 40. In other configurations, the flexible ribs may comprise other protrusions as described above with respect to the first gripper arm.

The frame 133 may include a frame channel 144 positioned proximate the first side edge. The frame channel would correspond to the frame channel 44. The frame channel provides a point of collection for the hair as the hair is pulled through the hair color applicator. In the embodiment shown, the channel 144 comprises a arcuate depression that is generally uniform in cross-sectional configuration across the portion of the frame so that the channel is generally parallel to the flexible ribs and generally parallel to the hinge 16. As can be seen, the frame channel 44 and the frame channel 144 matingly engage so as to provide a substantially cylindrical channel therebetween. In other embodiments, the two channels can be formed together in other shapes. In still other configurations, the two may be staggered so as not to correspond. In still other embodiments, the frame channel can be omitted from each of the gripper arms.

With reference to FIGS. 6 through 9, encircling portion 122 of the second gripper arm 14 extends about the applicator surface of the second gripper arm so as to define an inner cavity 156 (configured to capture the fingers of a user) with access to the cavity being through lower edge opening 158. In the embodiment shown, the encircling portion includes a back panel 150 as well as first side panel 152 and second side panel 154. The two side panels are triangular in shape so that the inner cavity tapers toward the distal end of the applicator panel, and that it is generally largest at the lower edge opening 158 (although variations are contemplated). It is contemplated that other shapes for the inner cavity are contemplated and it is contemplated that the lower edge opening 158 may be narrower than the largest cross-sectional configuration thereof.

With reference to FIGS. 1, 2, 3, 6 and 8, the hinge 16 comprises a live hinge that is formed along with the first and second gripper arms. In the embodiment shown, the hinge 16 extends from the first side edge to the second side edge of the applicator panels and is defined by the proximal end of the applicator panels. It will be understood that other types of couplings, that is, couplings that are hinges having a pin as the point of rotation, or a plurality of distinct and separate hinge members lying along the pivoting axis of the two gripper arms, are contemplated. In still other embodiments, a hinge that extends away from the proximal ends of the applicator panels in a loop like fashion is likewise contemplated. It is also contemplated that the two gripper arms may be separable from each other, or that they may be releasably attachable to each other. One advantage of the configuration shown is that the configuration provides for a compact easy to store configuration wherein separate components could otherwise be lost. In the configuration shown, the lower edge opening 58 and the lower edge opening 158 are disposed at an angle of 169° therebetween. Of course, in other configurations, different angular configurations are contemplated.

To utilize the hair color applicator of the present disclosure, the user first is provided with the applicator and a hair color solution. Typically, the hair color solution comprises a flowable material that includes pigment and chemicals to effectuate the coloring of hair. The user places a desired quantity of the hair color solution within the reservoir of at least one of the gripper arms (or alternatively both of the gripper arms). Once the applicator is filled with the hair colorant, the user can grasp a portion of the hair of a customer that is to be colored and position it between the first and second gripper arms.

Once the hair is positioned, the user can apply pressure against the applicator panel of each gripper arm to force the two gripper arms to rotate about the hinge toward each other. Eventually, the two gripper arms sandwich the hair therebetween and the hair comes into intimate contact with the colorant which is dispersed within the reservoir and along the surface of the flexible ribs. Additionally, the cooperating frame channels 44 assist with the maintenance of the hair in the proper orientation relative to the reservoirs. The user then pulls the hair through the applicator, or otherwise passes the applicator across the hair. This can be repeated to achieve the desired effect on the hair of the customer. It will be understood that due to the flexibility of the applicator, the configuration of the reservoir can changed based upon pressure applied by the user.

The process can be repeated as desired until the desired level of colorant has been applied to the hair. It will be understood that the orientation of the hair, portions of the hair and strands of the hair can be varied along the length thereof.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A hair color applicator comprising:

a first gripper arm having a proximal end, a distal end opposite the proximal end, first and second side edges extending between the proximal and distal ends and a first applicator panel extending continuously between the proximal and distal ends and the first and second side edges;

a second gripper arm having a proximal end, a distal end opposite the proximal end, first and second side edges extending between the proximal and distal ends and a second applicator panel extending continuously between the proximal and distal ends and the first and second side edges;

a hinge coupling the first gripper arm to the second gripper arm proximate the proximal ends of each panel, so as to have the applicator panels movable relative to each other toward and into a generally abutting position;

wherein the first and second applicator panels each comprise: an applicator surface having a centrally located reservoir with a frame extending therearound, the centrally located reservoir including a concave surface having a plurality of protrusions extending inwardly therefrom and the frame having first and second end walls extending generally perpendicularly with respect to the hinge and the plurality of protrusions, wherein the frame includes a frame channel extending from the first end wall to the first side edge of the applicator panel, the frame channel forming a depression parallel to the plurality of protrusions through which a user's hair exits during application of hair color thereto.

2. The hair color applicator of claim 1 wherein the plurality of protrusions extending inwardly from the concave surface comprise a plurality of ribs extending along the concave surface.

3. The hair color applicator of claim 2 wherein the plurality of ribs extend between the first side edge and the second side edge, generally parallel to the hinge.

4. The hair color applicator of claim 3 wherein the plurality of ribs comprise a plurality of rib pairs, each rib pair having a rib pair spacing defined as a distance between the ribs forming the rib pair, wherein each rib pair is spaced from an adjacent rib pair by a separation distance, the rib pair spacing being smaller than the separation distance between adjacent rib pairs.

5. The hair color applicator of claim 4 wherein each of the plurality of ribs has a substantially rectangular cross-sectional configuration.

6. The hair color applicator of claim 1 wherein the concave surface is substantially uniform between the first end wall and the second end wall so as to define a substantially uniform cross-sectional configuration.

7. The hair color applicator of claim 6 wherein the plurality of protrusions comprise a plurality of ribs extending in a substantially parallel configuration between the first end wall and the second end wall and substantially perpendicular thereto.

8. The hair color applicator of claim 7 wherein the plurality of ribs comprise a plurality of rib pairs, each rib pair having a rib pair spacing defined as a distance between the ribs forming the rib pair, wherein each rib pair is spaced from an adjacent rib pair by a separation distance, the rib pair spacing being smaller than the separation distance between adjacent rib pairs.

9. The hair color applicator of claim 1 wherein the centrally located reservoirs and the frame extending therearound are substantial mirror images of each other about the hinge.

10. The hair color applicator of claim 9 wherein the protrusions of the first applicator panel and the protrusions of the second applicator panel are substantial mirror images of each other.

11. The hair color applicator of claim 9 wherein the plurality of protrusions of each of the first applicator panel and the second applicator panel comprise a plurality of ribs extending in a substantially parallel configuration between the first end wall and the second end wall and substantially perpendicular thereto.

12. The hair color applicator of claim 11 wherein the plurality of ribs comprise a plurality of rib pairs, each rib pair having a rib pair spacing defined as a distance between the ribs forming the rib pair, wherein each rib pair is spaced from an adjacent rib pair by a separation distance, the rib pair spacing being smaller than the separation distance between adjacent rib pairs.

13. The hair color applicator of claim 1 wherein the frame channel of the first gripper arm is aligned with the frame channel of the second gripper arm.

14. The hair color applicator of claim 13 wherein the frame channel of the first gripper arm and the frame channel of the second gripper arm cooperate to form a substantially cylindrical configuration.

15. A method of applying color to hair, the method comprising the steps of:

providing a the hair color applicator of claim 1, placing a hair colorant on at least one of the first applicator panel and the second applicator panel;

directing a portion of a length of hair between the first gripper arm and the second gripper arm;

rotating the first and second gripper arms about the hinge to sandwich hair between the first gripper arm and the second gripper arm, to, in turn, direct hair colorant onto the hair sandwiched thereby; and slidably directing the hair color applicator along at least a remaining portion of a length of hair to continuously expose the hair colorant to the hair sandwiched thereby.

16. A hair color applicator comprising:

first and second gripper arms, each gripper arm having an applicator panel extending continuously between opposing proximal and distal ends and opposing first and second side edges, a back panel having a distal end joined to the distal end of the applicator panel and extending away from the applicator panel to a terminal proximal end spaced from the proximal end of the applicator panel, and first and second side panels coupling the first and second side edges of the applicator panel to the back panel;

a hinge coupling the proximal end of the applicator panel of the first gripper arm to the proximal end of the applicator panel of the second gripper arm, so as to have the applicator panels movable relative to each other toward and into a generally abutting position;

wherein the first and second gripper arms define an inner cavity with a lower edge opening adjacent the proximal ends of the applicator and back panels to provide ingress into the inner cavity allowing for the fingers of a user to be positioned therein and to apply force against a back surface of the respective applicator panels to rotate the first and second gripper arms; and at least one of the first and second applicator panels comprises an applicator surface having a centrally located reservoir with a frame extending therearound, the centrally located reservoir including a concave surface having a plurality of protrusions extending inwardly therefrom and the frame having first and second end walls extending generally perpendicularly with respect to the hinge and the plurality of protrusions.

17. The hair color applicator of claim 16 wherein the plurality of protrusions extending inwardly from the concave surface comprise a plurality of ribs extending along the concave surface.

18. The hair color applicator of claim 17 wherein the plurality of ribs extend between the first side edge and the second side edge, generally parallel to the hinge.

19. The hair color applicator of claim 16 wherein the concave surface is substantially uniform between the first end wall and the second end wall so as to define a substantially uniform cross-sectional configuration.

20. The hair color applicator of claim 19 wherein the plurality of protrusions comprise a plurality of ribs extending in a substantially parallel configuration between the first end wall and the second end wall and substantially perpendicular thereto.

* * * * *